United States Patent [19]

Sollberger et al.

[11] 4,215,808

[45] Aug. 5, 1980

[54] PORTABLE ELECTRIC FASTENER DRIVING APPARATUS

[76] Inventors: Roger W. Sollberger, 5614 Beechmont Ave., Cincinnati, Ohio 45230; Walter J. Webb, 5117 Colerain Ave., Cincinnati, Ohio 45223

[21] Appl. No.: 972,274

[22] Filed: Dec. 22, 1978

[51] Int. Cl.[2] ..... B25C 5/10

[52] U.S. Cl. ..... 227/146; 173/119; 227/130; 227/132

[58] Field of Search ..... 173/119; 227/130, 132, 227/146

[56] References Cited

U.S. PATENT DOCUMENTS

| | | | |
|---|---|---|---|
| Re. 29,354 | 8/1977 | Malkin | 227/132 |
| 1,497,635 | 6/1924 | Parrish | 74/56 |
| 1,845,617 | 2/1932 | Metcalf | 227/146 |
| 2,814,041 | 11/1957 | Haley | 185/38 |
| 2,867,086 | 1/1959 | Haley | 60/51 |
| 3,042,924 | 7/1962 | Frostad | 1/46 |
| 3,172,121 | 3/1965 | Doyle et al. | 1/49 |
| 3,280,921 | 10/1966 | Bickford | 173/123 |
| 3,283,986 | 11/1966 | McKee | 227/120 |
| 3,366,302 | 1/1968 | Blicharski | 227/131 |
| 3,589,588 | 6/1971 | Vasku | 227/132 |
| 3,810,572 | 5/1974 | Malkin | 227/132 |
| 3,847,322 | 11/1974 | Smith | 227/132 |
| 3,913,685 | 10/1975 | Enstrom | 173/119 |
| 3,924,692 | 12/1975 | Saari | 173/117 |
| 3,924,789 | 12/1975 | Avery et al. | 227/131 |
| 3,982,678 | 9/1976 | Olson | 227/63 |
| 4,042,036 | 8/1977 | Smith et al. | 173/13 |
| 4,121,745 | 10/1978 | Smith et al. | 227/7 |
| 4,129,240 | 12/1978 | Geist | 227/8 |

*Primary Examiner*—John McQuade
*Attorney, Agent, or Firm*—Wood, Herron & Evans

[57] ABSTRACT

A portable electric fastener driving apparatus includes a unique fastener driving element operatively connected to the piston of an air spring which is charged to provide energy for driving fasteners. The air spring is charged by a unique jacking and release system including a drive gear selectively engaging a rack on the driving element to move the piston and compress the air spring. Motive power for the jacking apparatus is provided by a motor, preferably remote from the driver apparatus and connected thereto by a flexible drive cable. Control apparatus is included.

31 Claims, 12 Drawing Figures provides the forces required for driving construction-duty fasteners with generally greater efficiencies than known pneumatic guns, and with less bulkiness, weight and awkwardness than in electric guns involving mechanical springs or flywheels, for example.

The combination of a remote motor with a fastener gun provides a highly unique result in that electric portable guns can now be provided at a substantial weight and size reduction over those electric guns using motors or solenoids, for example, in the gun. With the removal of the motor weight, the gun is much more easily handled.

Also, it shall be noted that the combination of an air spring and remote motor provides several unique results not available from the separate elements or in known guns. Particularly, while the use of an air spring is highly advantageous from an efficiency and space saving viewpoint, an electric motor of a size capable of charging the air spring in a reasonable time period would render the resulting gun undesirably heavy and unwieldy. The combination of the air spring and its advantages with a remote motor thus produces high efficiencies, without the weight and bulkiness which might otherwise render the gun undesirable. The practical result being an electric, portable, construction-duty gun operating at peak efficiencies, yet with a weight and size comparable to a pneumatic gun but without the air hose and compressor required for pneumatic guns.

The preferred embodiment of the invention further includes a unique jacking apparatus for charging the air spring. Particularly, a gear train operatively connects the flexible torque or drive cable to the fastener driving element in the gun through a drive gear movable into and out of engagement with a rack on the driving element. The element is connected to the working piston of the air spring and the element and piston are jacked to charge the air spring. Frictin in the gear train pivots the drive gear into engagement with rack, and the drive gear is released from the rack, to permit the element to drive a fastener, when the drive is interrupted and released through a discontinuous segment of teeth on another gear in the gear train. This jacking means is highly advantageous in its simplicity.

In conjunction with the gear train of the preferred embodiment, an electrical control circuit includes a two-contact switch controlled by a cam in the gear train and operating the circuit to provide sequential actuation of the gun, or automatic continuous operation upon continued depression of the trigger. A triple-contact relay operates with the switch contacts to produce this control function, as will be described.

Accordingly, the invention provides an improved electric portable fastener apparatus capable of the single impact driving of a construction-duty fastener with high efficiency and all in an extremely lightweight, small gun without the need for air hoses and compressors or heavy solenoids and flywheels.

These and other objectives and advantages will become readily apparent from the following description of the preferred embodiment of the invention and from the drawings in which.

Figure 1:
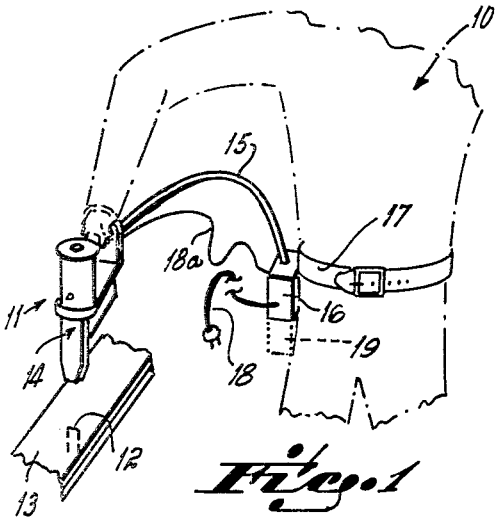
FIG. 1 is a perspective view showing in operation a portable fastener apparatus according to the invention.

Turning now to the drawings, FIG. 1 illustratively depicts the portable electric fastener apparatus according to the invention. As shown in FIG. 1, an operator 10 is supporting a fastener apparatus 11 for driving fasteners 12 into a workpiece 13. The fastener apparatus 11 comprises three basic elements, fastener gun 14, flexible drive cable 15 and operator carried motor 16. It should be appreciated that the fastener apparatus 11, according to the invention, can be constructed to handle different forms of fasteners such as nails, staples or other forms of driven fastening devices. The preferred embodiment, however, is directed to gun 14 which is particularly constructed for the handling of construction-duty staples 12. For purposes of description in this application, a construction-duty staple fastener is considered to be a staple having a leg length of approximately 1-2 inches or more and made of, for example, 0.059 inches wire, the gun 14 being capable of driving such construction-duty staples into workpieces, such as wood, drywall and the like with a single impact. This is to be contrasted with a staple having a leg length of ½ inch, made from 0.020 inch wire, and generally referred to as a light-duty staple.

With further respect to FIG. 1, it is appreciated that the motor 16 is shown mounted on the belt 17 of the operator 10. In this regard, the motor could be mounted in any position on the operator or could be otherwise disposed for operating the gun 14. Preferably, electrical energy is supplied to the motor via a light electrical line cord 18 which can be plugged into any suitable electrical receptacle in the general area where the fastening is to be done. A second electrical conductor 18*a* is operatively connected between the motor location and the gun 14 for conducting control signals between the motor and gun as will be appreciated. It will be appreciated that the motor 16 could alternately be supplied with a battery pack 19 for providing a source of electrical energy to drive the motor.

The light weight and ease of handling an electrical line cord provides substantial advantages to the invention as compared with the heavier, awkward pneumatic air hose and compressor generally required for pneumatic stapling guns. For complete portability, of course, where no electrical source is immediately available, the battery pack could be utlized alternatively to the electrical line cord.

PORTABLE ELECTRIC FASTENER DRIVING APPARATUS

This invention relates to fastening apparatus and more particularly to portable, electric apparatus for applying fasteners such as staples and nails.

Portable fastening guns for applying fasteners are well-known in the art, yet actual portability is in most cases substantially diminished by weight of the fastener gun, whether electric or pneumatic, or by the awkwardness of the hoses and compressors necessary for pneumatic guns. Pneumatic guns are highly advantageous, as a result of the fastener driving power they are capable of generating, but nevertheless they have the inherent disability of the need for a compressor on the job and for the pneumatic connecting hoses which are heavy, bulky, and awkward.

Moreover, the pneumatic guns have an inherent disadvantage in the context of their operating efficiencies. In a typical pneumatic gun, for example, the motive pressure is used during a stroke in driving the fastener and, as well, in charging a return chamber for raising the operating piston. Also, upon raising the operating piston, in a conventional pneumatic gun, the charge of pressurized air thereabove is exhausted, leading to further inefficiencies.

A further and perhaps more important operating inefficiency of pneumatic guns generally is that the guns are typically fired by pressurized air stored in the chambers of the gun and operating the driver piston in the air cylinder through a firing or poppet valve. Considering the firing stroke in parts, maximum drive pressure above the piston is not realized then at the beginning of the stroke, for it is not transmitted from the pressure storage chambers to the cylinder above the piston as quickly as is desirable. Thus the piston is not initially driven with the force which is capable of being generated by a pressure equal to that above the piston at later points in its stroke. While some efforts of others have been aimed at providing quick-acting valves which fully open before piston movement, this ideal has not been known to have been fully obtained.

Practically then, the pneumatic guns are relatively weak at the beginning of the driver stroke, just when they need to generate the strongest force required for driving. They must thus be designed to accommodate this inefficiency.

Electric guns do not ordinarily have these particular deficiencies and they do have the potential for widespread ease of use in view of the usual availability of electricity. Known attempts, however, to provide electric fastener or stapler guns, and thus eliminate the air hose and compressor requirements of pneumatic guns, have not been entirely satisfactory. The failures are perhaps primarily due to the usual inherent awkward heaviness and relative low power of such guns when compared to pneumatic guns.

For example, U.S. Pat. No. Re. 29,354 discloses an electric stapler having a mechanical spring for driving the fastener and a motor for jacking the spring. The motor adds substantial weight to this gun and the spring requires a substantial length for construction-duty operation, rendering the gun relatively heavy and bulky as compared to a pneumatic stapler.

In U.S. Pat. No. 3,924,789, a solenoid operated gun includes both retracting and driving solenoids, the driving solenoid supplemented by a drive spring. Solenoids strong enough to generate construction-duty forces render a gun relatively heavy as compared to a fully pneumatic stapler.

Finally, U.S. Pat. No. 4,121,745 discloses a gun where the fastener driving member is driven by the action of opposed, motor driven flywheels. The motor and the flywheels contribute to awkwardness and weight of the gun.

Despite these designs and the other efforts of the stapling industry to produce a portable, construction-duty, electric stapler, no known effort has proved commercially successful. The nature of these designs requires undesirable weight or bulkiness, or both, to generate the force required to drive construction-type fasteners, and the complexities of the mechanical details have been difficult to overcome for a commercial production gun.

Accordingly, it has been one objective of this invention to provide an improved, electric, portable fastener apparatus.

A further objective of the invention has been to provide an improved electric, portable fastener apparatus capable of driving construction-duty staples.

A further objective of the invention has been to provide an improved lightweight, electric, portable, construction-duty fastener apparatus without the use of solenoids, mechanical springs or flywheels for fastener driving.

A further objective of the invention has been to provide an improved jacking apparatus for charging a fastener driving means.

A further objective of the invention has been to provide an improved driving apparatus for an electric, portable fastener apparatus.

A further objective of the invention has been to provide an improved electric, portable, magazine-fed, fastener apparatus capable of single impact driving a construction-duty fastener.

A still further objective of the invention has been to provide an electric, portable, fastener apparatus capable of driving construction-duty fasteners with greater efficiencies than comparable force output pneumatic guns.

In furtherance of these objectives, applicants have realized the desirability of an electric, portable, lightweight, construction-duty fastening apparatus unencumbered by the bulk and weight of solenoids, flywheels, mechanical springs, air hoses and compressors.

To these ends, a preferred embodiment of the invention contemplates an electric portable fastener driving apparatus capable of driving construction-duty fasteners without using solenoids, flywheels, mechanical springs or electric motors in the gun. More particularly, a preferred embodiment of the invention contemplates a fastener driving gun comprising a driver element, an air spring for driving the element, jacking apparatus for moving the element to charge the air spring, and motive power for the jacking apparatus in the form of an operator mounted motor connected to the gun by a flexible torque or drive cable.

The utilization of an air spring, which is charged by jacking the working piston in the air cylinder, alone provides a unique result when combined with a fastener gun. Particularly, the potential energy of the spring is at the greatest at the beginning and initial portions of the stroke. Full peak pressure is available at the moment of greatest potential energy when the piston is at its uppermost position in the air cylinder. Such a combination comprise elements of the jacking means 22 which will be hereinafter described.

While the term "air spring means" is used herein with reference to the sealed cylinder and piston, it should be appreciated that the term "air spring means" as used herein refers to a compressed fluid cylinder or expansible chamber apparatus wherein the working pressure is substantially provided by and in response to the movement or jacking of the piston into the cylinder. This is contrasted to cylinder structures wherein compressed air is forced into the cylinder, via other means such as a compressed air supply, for each cycle.

Jacking Means

The jacking means includes, in addition to the toothed rack on the drive element and the drive gear, a second gear 63 in constant engagement with the drive gear 61. The second gear 63 is mounted on a gear shaft 64 (see FIG. 6) and a third gear 65 is mounted on a rearward end of the shaft 64. The shaft 64 has its ends journaled in a subhousing 66 which is mounted in a cutout 29 in a housing plate 27.

In order to provide for the movement and selective engagement of the drive gear 61 with the rack teeth 60, it will be noted that the drive gear 61 is rotationally mounted on a shaft 68 which is journaled in a drive gear housing 69 by means of bushings 70 and 71, a cap screw 72 in shaft 68, and washer 73. While the shaft 68 and pinion 61 is thus rotatable within the drive gear housing 69, the cap screw 72 may be adjusted so as to vary the pressure exerted via the washer by the bushing 71 on the housing 69 and thereby vary the friction which must be overcome in order to drive the shaft 68 and gear 61 within the housing 69. In some instances, simple inertia of the system will move gear 61 toward driver element 30, however, the frictional relationship described may be used to ensure this engagement.

Figure 4:
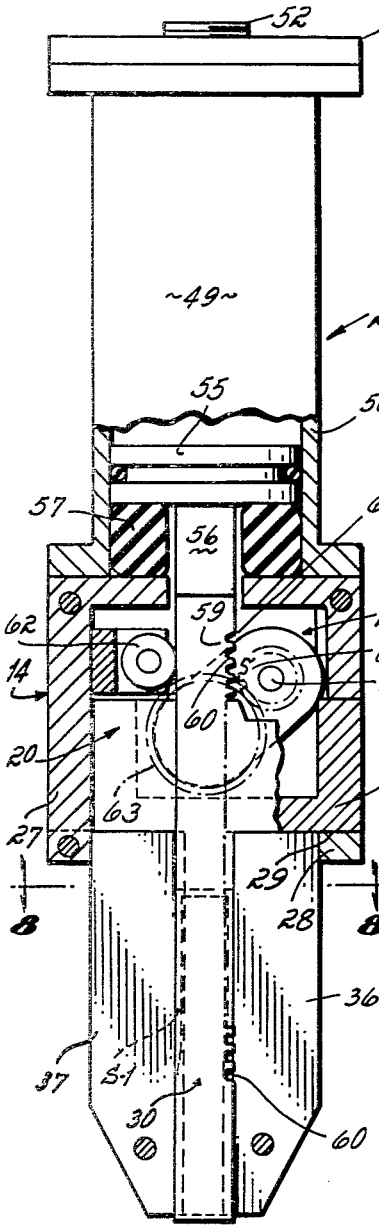
FIG. 4 is a cross-sectioned view taken along lines 4—4 of FIG. 3, the driver being in its lowermost position.
Figure 5:
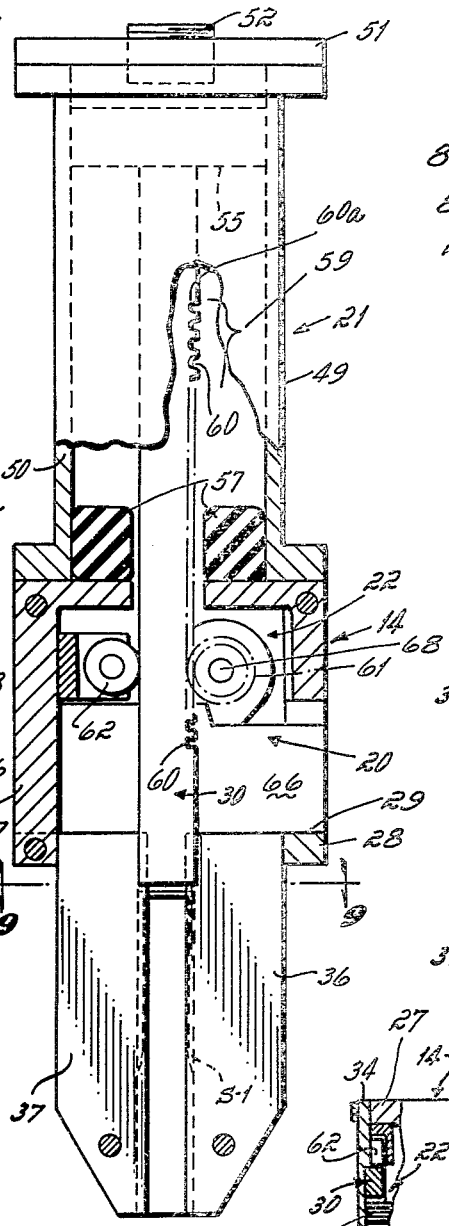
FIG. 5 is a cross-sectioned view similar to FIG. 4 but with the driver in its raised position.
Figure 6:
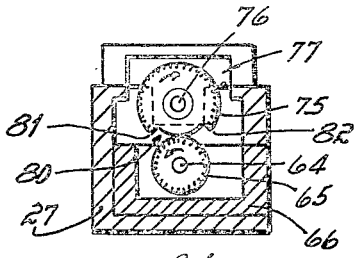
FIG. 6 is a cross-sectional view taken along lines 6—6 of FIG. 3.

As will be further described, the gear 65 is driven in a counterclockwise direction, as viewed from the front (FIG. 6). Assuming the drive gear housing 69 to be in its withdrawn position, as shown in FIG. 4, wherein the drive gear 61 is disengaged from the rack teeth 60, it will be appreciated that when the shaft 64 and the gears 65 and 63 are driven in a counterclockwise direction (FIGS. 4 and 6) the friction exerted through the bushing 71 on the housing 69 serves to retain gear 61 and shaft 68 stationary with respect to the housing 69. Thus rotation of the gear 63 tends to drive the pinion or gear 61 upwardly and into engagement with the rack teeth 60. Once the teeth of the gear 61 engage the rack teeth 60, the pressure exerted on the gear by the rack teeth 60 is sufficient to maintain the pinion 61 in a driving engaged position (FIG. 5) and thus to drive the driving element 30 upwardly, the friction of the shaft 68 and bushing 71 with respect to the housing 69 being overcome. A back-up roller 62 is mounted in the housing 27 and is disposed to support the driver element 30 opposite the position of the gear 61 when engaged with the element 30.

In this regard, a relieved chamfer 60*a* may be provided on the rack teeth 60 in the area 59 of first gear engagement to ensure positive initial engagement of the gear 61 with rack teeth 60. Thus the teeth of the rack in upper area 59 are more tapered than the remaining teeth on the rack. At this point, there is relatively little pressure in the cylinder and this feature enhances early drive engagement to ensure full stroking of the rack for the drive revolution of a segmented gear 75 as will be described.

When the drive train in released, as will be described, the pressure of the air spring means 21 exerted through piston 55 onto driving element 30 is sufficient to move the driving element downwardly for driving the staple and at the same time, tends to throw the drive gear 61 away from the driving element into the position shown in FIG. 4 where the housing 69 rests on the subhousing 66 with the drive gear 61 being disengaged from the rack teeth 60.

Further describing the jacking means 22, a segmented gear 75 is mounted on shaft 76 which is rotationally journaled in a further subhousing and journal 77. Shaft 76 is connected through a coupling 78 to a drive shaft 79, which is an operative rotating part of the flexible cable 15, for the purpose of driving the segmented gear 75. Cable 15 includes a screw fitting 90 operatively connected to coupling 24 for maintaining shaft 79 in engagement with coupling 78.

The segmented gear 75 is further illustrated in FIG. 6 and it will be appreciated that the segmented gear comprises a gear wheel which has a 90° relieved segment 80 wherein there are no gear teeth. The relieved segment 80 is further defined by gear teeth 81 and 82 on the gear wheel 75. These teeth comprise, respectively, last and first drive teeth on gear 75. The relieved segment 80 is provided for the purposes of releasing the jacking means 22 so that the air spring means 21 is operative to drive the driving element 30 downwardly and thus drive the staple S-1. In this regard, it will be appreciated that the peripheral extent of the segmented gear wheel 75 between the gear teeth 81 and 82 is of a sufficient peripheral dimension, when taking into account the remainder of the gears of the jacking means 22, to drive the driving element 30 upwardly through a full stroke. In a preferred embodiment, wherein a compression stroke is approximately 3 inches, the segmented gear wheel 75 has a pitch diameter of 1.27 inches and the remaining gears 61, 63 and 65 are provided in order to produce the three-inch lift or jacking stroke.

In addition to segmented gear 75 mounted on shaft 76, a cam 85 is also mounted on a shaft 76 and has a relieved portion 86 for controlling the cam follower 87 of a control switch SW-1, which will be described.

Motor

In order to drive the jacking means 22 to compress the air spring means 21 in a fashion suitable for driving construction-duty staples, a motor 16, comprising a source of driving energy, is remotely disposed with respect to the gun 14 and is connected thereto by means of the flexible drive cable 15. The motor 16 is preferably a 0.25 hp, 125 rpm electric motor which is believed to have the capacity to drive the jacking means 22 against the air spring means 21, having a bore of one and one-half inches and a three-inch piston stroke, and in about ½ second. Of course, any suitable electric motor of differing capacities could be utilized.

Drive Cable

Figure 2:
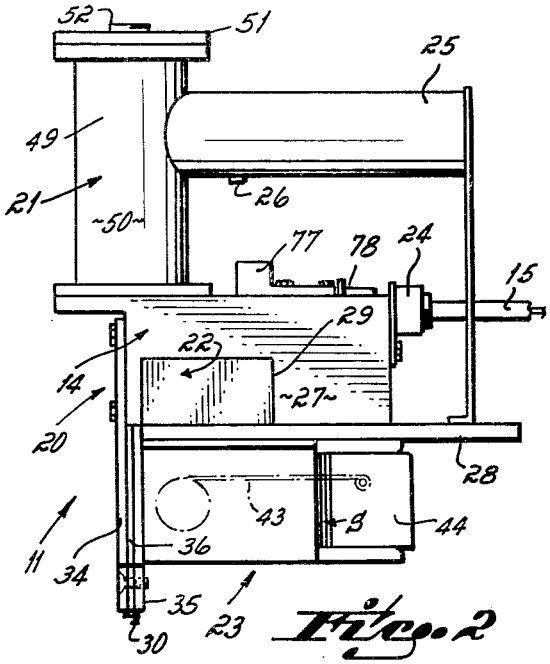
FIG. 2 is a side view of the preferred embodiment of the fastener apparatus according to the invention, but without showing the motor.

The flexible cable 15 comprises a drive cable of well-known type having an outer sheath 15*a* and an interior, elongated driving or torque transmitting member 15*b*, each of which is flexible and is capable of transmitting the torque generated by the motor 16 to the jacking means 22. Such a cable has on each end thereof a screw fitting 90 connecting the outer sheath 15*a* to the housing or coupling member 24 of the gun at one end thereof, and to the motor 16 at the other end thereof (not The side view of FIG. 2 illustrates more of the details of the gun 14. In the preferred embodiment, the gun 14 constitutes a portable, electric, magazine-fed, stapling gun capable of fully driving a construction-duty staple as defined herein. The gun comprises a driver assembly 20 at the lower front end of the gun, air spring means 21 operatively disposed above the driver assembly 20, jacking means 22 (see FIG. 3), replaceable magazine 23 removably mounted in the gun and biasing a plurality of staples toward the driver assembly, flexible cable coupling 24, handle 25, and trigger switch 26. The gun also comprises a housing 27 surrounding the jacking means 22.

The housing 27 encloses a substantial portion of the jacking means 22. In a preferred commercial embodiment, the housing 27 will comprise a casting, however, it is shown in the drawings in plate form for illustrative purposes and includes the plate structure 27 and floorplate 28. Any suitable housing will suffice. The jacking means 22 is provided with further housing components as will be described.

Driver Assembly

Figure 3:
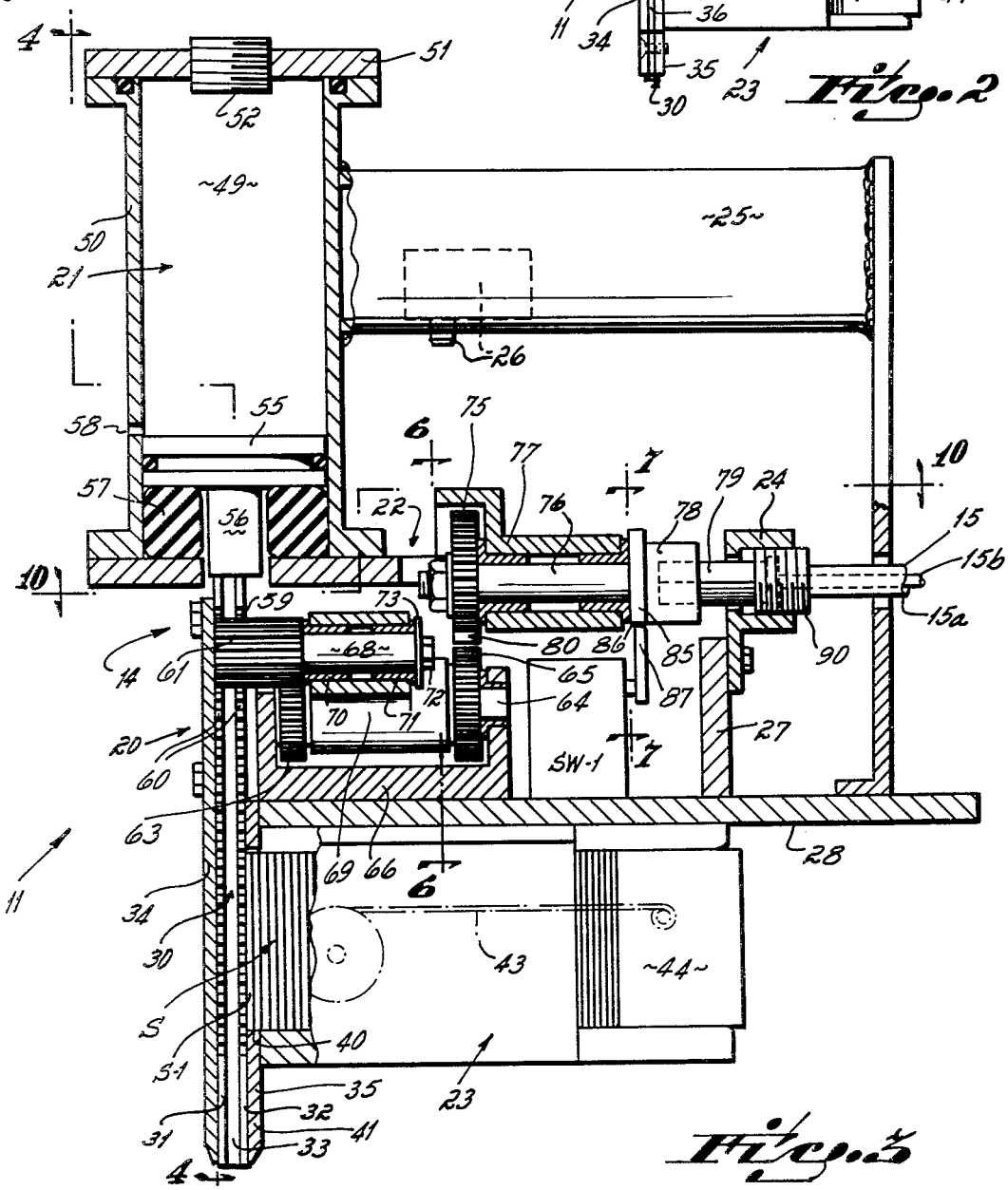
FIG. 3 is a sectioned side view of the apparatus of FIGS. 1 and 2.
Figure 8:
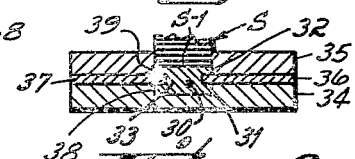
FIG. 8 is a cross-sectional view taken along lines 8—8 of FIG. 4.
Figure 9:
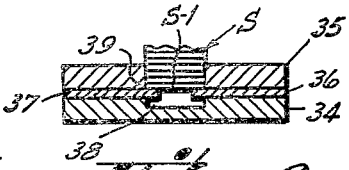
FIG. 9 is a cross-sectional view taken along lines 9—9 of FIG. 5.
Figure 10:
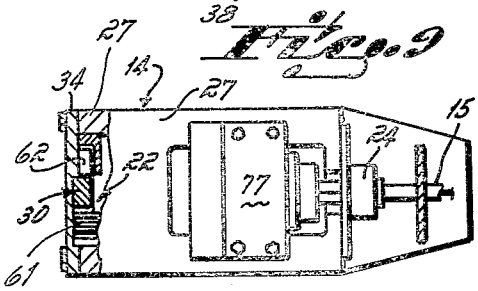
FIG. 10 is a broken, top view taken along lines 10—10 of FIG. 3.
Figure 11:
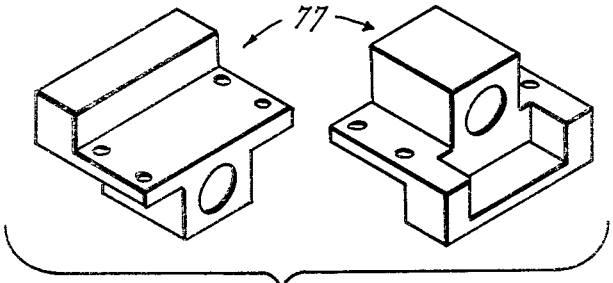
FIG. 11 is a perspective view of the subhousing and shaft journal shown in FIGS. 2 and 3, the subhousing and journal being shown first in an upright position and then in an inverted position for clarity.

Considering now the details of the various features of the gun 14, the driver assembly details are best seen in FIGS. 3–5, 8 and 9. The driver assembly comprises a driver element 30 which is shown in FIGS. 3 and 8 to be H-shaped, having spaced, parallel flanges 31 and 32 joined by a web 33. The driver element 30 is shown in FIGS. 3 and 4 in its extended, downward position at a time in the cycle when it has driven a staple and is at rest awaiting the start of another stapling cycle. The driver element 30 is mounted between forward and rearward support plates 34 and 35 which are preferably grooved at 38 and 39, as shown, for slidingly accepting the driver assembly 30. The plates 34 and 35 are spaced apart by respective plates 36 and 37 which extend into the space defined by the grooved slots 38 and 39 in plates 34 and 35, and further extend between the flanges 31 and 32 of the driver element 30. The dimensions of the driver element 30 and the construction of the plates 34, 35, 36 and 37 are selected such that the driver element 30 is free to slide within the plates for driving a staple. As shown in FIGS. 3, 8 and 9 a plurality of staples S are held in a position for sequential feeding to the driver apparatus from a rearward portion thereof, as shown in FIGS. 3 and 8. A forwardmost staple S-1 is positioned agaist flange 32 of the driver element 30 through a cutout 40 and the rearward support plate 35. Once the driver element 30 is raised above the staple S-1, the staple will move forwardly against plates 36 and 37 where it is held until the driver 30 descends to drive the staple between the plates 36 and 37 and a lower portion 41 of the rearward support plate 35. The space between the plates 36 and 37, and the lower portion 41 of the rearward support plate 35, together with the space immediately thereabove in which the staple resides before driving can, for reference or identification purposes, be referred to as a fastener or staple drive path or drive track. In this connection, it is noted that flange 32 of the driver element is of a selected thickness and width substantially equal to that of the crown of staples S.

Magazine

The staple loaded magazine 23 can be of any suitable form for introducing the staples S to the driver assembly 20 and can be removable or non-removable from the gun. Also, a simple strip of staples could be inserted into the permanent springloaded magazine of the gun. As shown, the magazine 23 includes a spring means 43 and a follower 44 for urging the staples S toward the driver assembly 20.

Air Spring

The air spring means 21 comprises a pneumatic cylinder 49 defined by cylinder walls 50 and an upper end cap 51. End cap 51 is provided with a threaded aperture and an adjusting screw 52 therein. Adjusting screw 52 has a substantial diameter and can be screwed into and out of the end cap 51 to adjust the air space volume within the cylinder 49 and thereby the firing pressure of the air spring means 21.

The air spring means 21 further includes a working piston 55 reciprocal within the cylinder 49 and being operatively connected at a lower side thereof to the driver element 30 by way of connecting member 56 attached to the piston and to the driver element 30. Any suitable connection of the driver element 30 to the working piston 55 will suffice, and, for example, may comprise a boss 56 positively or integrally connected to the lower side of the piston 55 and also positively connected through pin means (not shown) or other means to the driver element 30. Of course the piston includes a seal with the walls 50 and end cap 51 is sealed appropriately to provide a relatively air-tight cylinder.

The lower end of the cylinder is provided with a piston stop 57 which, as shown, comprises a rubber or elastomer annulus forming a cushion for the piston 55. As shown in FIG. 3, both the upper and lower ends of the cylinder walls 50 are flanged for respective connection to the upper end cap 51 and to the housing 27 by means of appropriate screws, bolts or the like (not shown).

In a production model, of course, it would be preferred to provide the housing, the cylinder, and other parts of the gun in the form of a casting, the details of the gun, as shown in FIG. 3, being for illustrative purposes only.

An air vent 58 is preferably provided in the cylinder wall 50 at a lower end of the cylinder such that it vents the internal cylinder when the piston 55 is in its lowermost or expended position. When the piston 55 is raised from its position as viewed in FIG. 3, it passes the vent 58 and thereafter, during its upward movement, compresses any air in the cylinder 49.

In an alternative embodiment, the vent 58 is eliminated and an air value is provided within the cylinder so that the cylinder can be preloaded with a predetermined degree of pressure. In this way the operating or firing pressure available through the air spring means 21 can be raised to meet particularly heavy-duty applications.

In order to charge the air spring means 21, i.e. to move the piston 55 upwardly to compress air within the cylinder 49, the jacking means 22 is operative to raise the piston 55 by means of a driven gear and rack provided directly on the driver element 30. As shown in FIGS. 3 to 5, the driver element 30 includes a plurality of teeth 60 on respective edges of the flanges 31 and 32 at one side of the driver element 30. A drive gear 61 is mounted for movement toward and away from the gear teeth 60 on the driver element 30 for selective engagement with the element in order to raise the element and thus the piston 55 to charge the air spring means 21. The rack formed by the gear teeth 60 and the drive gear 61 shown). At the gun, the elongated member 15b of the cable extends through the screw coupling 90 and by virtue of its multi-sided end shape at 79 is disposed within a multi-sided receptacle within the coupling 78 for driving engagement with the shaft 76.

Control

Figure 12:
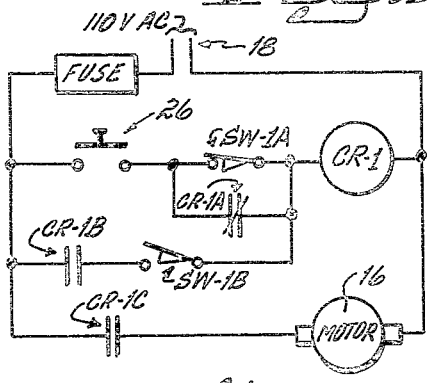
FIG. 12 is a diagrammatic view of one form of control circuit for the apparatus of FIG. 1.

An exemplary electrical control circuit for the gun is illustrated in FIG. 12. It should be appreciated that preferably, ordinary 110 volt A.C. line voltage is used to energize the motor and that FIG. 12 only diagrammatically depicts one suitable control circuit. The circuit can be modified as desired with rectifiers, transformers and the like for use with line voltage or alternately for use with a battery pack 19 which can also be carried by the operator in any fashion, such as on his belt. In this event, the motor is constructed to perform with the circuitry desired.

The circuit includes the trigger switch 26 which is mounted in the handle 25 of the gun, the control switch SW-1 (FIG. 3), which has two contacts, SW-1A (normally closed) and SW-1B (normally open), and a control relay CR-1, having three contacts CR-1A, CR-1B and CR-1C. The relays and its contacts can be mounted in the handle of the gun, within the housing 27 of the gun or alternately in any other suitable position on the gun, or on the belt of the operator proximate the motor, and are appropriately connected in a control circuit as shown in FIG. 12. The components of the control circuitry are connected, as preferably shown in diagrammatic FIG. 12, by means of appropriate electric conductors extending between the components, the motor and a source of energy.

Figure 7:
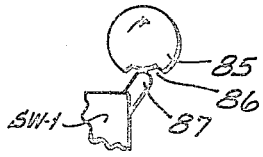
FIG. 7 is a cross-sectional view taken along lines 7—7 of FIG. 3.

Turning now to FIG. 12, the operation thereof will now be described. When the trigger switch 26 is depressed, it makes a circuit across the trigger switch contacts and across the normally closed contacts SW-1A of the switch SW-1, thus energizing the control relay CR-1. The control relay CR-1 has three contacts. These are CR-1A, which is normally closed, and CR-1B and CR-1C which are normally open. When the control relay CR-1 is energized, contacts CR-1C are closed to energize the motor 16, which drives the flexible cable 15 and the jacking means 22. This rotates the cam 85 from its position as shown in FIG. 7 and the cam follower 87 is moved outwardly of the recess 86, thereby opening SW-1A contact and closing the SW-1B contact. The motor continues to be energized, even though the switch 26 is released, through the now closed contact CR-1B and the now closed contact SW-1B. Once, however, the cam 85 rotates so that the cam follower 87 falls into the relieved area 86, the contact SW-1B is opened and, the trigger switch 26 being opened, all circuits to the control relay CR-1 are open. The disconnection of the relay CR-1 returns the contact CR-1C to its open position and the motor 16 stops, awaiting another cycle caused by the closing of the trigger switch 26.

If trigger switch 26 is held down, the falling of the follower 87 into the relieved portion 86 of the cam 85 is not operative to stop the motor. The contact SW-1A is closed as soon as the follower 87 falls into the recess 86, and a subsequent circuit is thus made through the control relay CR-1 to repeat the cycle. According then to this circuitry, the gun of the invention is capable of sequential single firing by depression and immediate release of the trigger 26, or of automatically continuously firing caused by continued depression of the trigger switch.

Of course, a mechanical safety apparatus (not shown) which does not constitute part of this invention, may be added to the gun so that the gun is rendered incapable of firing unless the lower end of the driving apparatus 20 is disposed within an operative distance from a workpiece, as is well known in the art for other types of stapling devices. Alternately, the control circuit could be provided with mechanical or optical switching means disposed at the forward end of the gun for electrically preventing firing unless the gun is in an appropriate position adjacent a workpiece.

Operation

Accordingly, then, in operation, the trigger switch 26 is depressed which energizes the motor 16 and thereby drives the cable 15 to drive the jacking means 22. Rotational energy is thus delivered by the motor through the cable 15 to the jacking means, and thus through the gear train, as described, to the rack teeth 60 on the driver element 30. Once the gears 75, 65 and 63 are driven, the friction of the shaft 68 on the housing 69 holds the drive gear 61 and, as a result, housing 69 and gear 61 move toward engagement with the teeth 60 of driver element 30. Once the gear 61 engages the rack teeth 60, the driving element is raised upwardly to charge the air spring means 21, i.e. moves piston 55 upwardly to compress the air within the cylinder 49. Continued driving by the motor 16 drives the segmented gear 75 in a clockwise direction (FIG. 6) until gear tooth 81 disengages from the gear 65. The driving element 30 (and piston 55) is thus released and is immediately driven downward with the force exerted by the pressure in the air spring means 21. At the same time, the downward movement of the driving element 30 tends to kick the drive gear 61 over into its disengaged position as shown in FIG. 4, although this is not entirely necessary since even continued engagement of the rack teeth 60 with the drive gear 61 would simply counter-rotate the gears 61, 63 and 64, which remain disengaged from the segmented gear 75 until the completion of the stroke and a further operation of the trigger switch 26. Of course, the relieved portion 86 of the cam 85 and the 90° relieved segment 80 of the segment in gear 75 are timed to provide the operation which has been described.

It will further be appreciated, of course, that regardless of the particular jacking means and drive motor, the air spring is operable to produce the same results and advantages. Namely, when the air spring is compressed, the total available pressure for firing the gun is available at the top of the driving element stroke. When the driving element is released, the maximum energy is immediately applied to initiate the staple stroke.

Further, no energy is wasted in the air spring, according to this invention, for generating return pressure. Specifically, the cylinder is vented at the bottom through the annulus 57 and the housing 27, and, in the preferred embodiment, by vent 58.

Further in connection with the operation of the invention, it will be appreciated that the screw 52 can be rotated into and out of the air cylinder 50 so as to adjust the operating, or firing, pressure of the air spring means 21. Thus if greater forces are required, the screw 52 is turned inwardly into the cylinder, reducing its volume and providing greater pressure, for the same piston movement, than when the screw is not turned into the cylinder so far.

By way of further describing the operation of a preferred embodiment of the invention, the air spring in the embodiment shown in the drawings includes a cylinder bore of approximately 1.5 inches in diameter and a piston stroke of approximately 3 inches, from the bottomed positioned shown in FIG. 4 to the uppermost position shown in FIG. 5. Comparing, then, the portable, electric fastening apparatus described herein, and a typical pneumatic stapling gun, where the two different guns have the same power output capability, a one and one-half inch bore and a three inch stroke, and the conventional pneumatic gun utilizes a piston air return having a storage chamber of approximately 30% of the working volume of the gun, it will become immediately apparent that the invention described herein is capable of the same power output as a comparable conventional pneumatic gun, however, the pneumatic gun requires a power input of approximately 3½ to 4 times or more of that required for the invention described herein. Specifically, the pneumatic gun, because of its requirement for a return air compression, and because of the dumping of the working air after each stroke upon piston return, among other things, is relatively inefficient when compared to the present invention where no return air is required and no complete dumping occurs.

Comparing the stapler of the preferred embodiment described herein with a mechanical, spring-powered electric stapler of the type described in U.S. Pat. No. Re. 29,354, for example, it will become immediately apparent that, when using the normal compression spring practice of 25% working deflection, a spring of approximately 12 inches in length and weighing about one pound would be required to produce the same power output in a commercial, portable stapler as the power output by the preferred embodiment described herein. The extended 12-inch length of such a spring would require the stapling apparatus to have a height of at least 12 inches above the driver and staple magazine assembly, thus rendering such a gun more awkward and heavier than the preferred embodiment described herein, and even without a consideration of the reduced weight of the invention by remoteness of the motor.

Thus the efficiencies of the preferred embodiment described herein, wherein an air spring means is utilized, are generated in part as a result of the fact that the compressed air of the air spring, whether vented or utilized in a non-vented preload fashion, is not reliant on the large size or the quantity of stored energy, but rather on the pressure of the working air generated in the cylinder by the jacking of the piston. This, coupled with the utilization of the remote motor, provides, in the preferred embodiment, a substantial power to weight ratio which is significantly better than the power to weight ratios of other known electric staplers.

Of course, the fastener apparatus described herein could be constructed for varying power outputs by selecting the initial pressure and the compression ratio to be utilized, which would result in the final desired pressure that best fits the power needs. In connection with this, of course, the electric motor is required to be of such construction as to generate enough power for cycling the tool at an acceptable rate, but it does not have a direct relationship to the power output. More specifically, if the initial pressure in the preferred embodiment fastening apparatus is 0 psig, and the working pressure is desired to be approximately 135 psig, we have found that a ¼ hp electric motor, when coupled with the gearing of the jacking means described herein, should produce power sufficient to cycle the apparatus in approximately ½ second. Such a cycling rate is sufficient for a substantial portion of stapling operations. The cycling time may vary somewhat, of course, depending on whether or not the vented cylinder embodiment, as shown in FIG. 3, is utilized, or whether a preload pressure through the use of a one-way valve in a non-vented cylinder, according to the invention, is utilized, and depending on the motor and gearing selected.

A further feature of the invention resides in its inherent safety. Particularly, the preferred embodiment has the advantage that it is never "cocked" until the trigger is engaged. This prevents a tool from being in a cocked status after it has been disconnected from the power source and laid aside, for example. Thus, unless the power source to the motor were connected, it would be impossible to fire the preferred embodiment, even in proximity to a workpiece or other surface.

Accordingly, the invention provides an electrical, portable, fastening apparatus capable of applying construction-duty fasteners by single impact in typical construction workpieces, such as lumber, drywall and the like, at a much lighter weight than previous electric staplers and with greater efficiencies and less awkwardness than prior electric and pneumatic staplers.

The provision of an air spring, compressed by jacking the fastener driver and piston against a column of air, whether at ambient pressure or at a preload pressure, provides in itself unique efficiency advantages in terms of the work input and work output ratio as compared with conventional pneumatic staplers. It also provides a highly advantageous operational feature in that peak pressure on the working piston is available at the point of peak potential energy at maximum piston height in the working cylinder.

In this regard, and according to one aspect of the invention in alternate embodiments, the invention contemplates use of varying kinds of motors, such as air or hydraulic, or otherwise both in and remote from the gun, and in combination with an air spring or jacking means or both, as described herein, to provide certain advantages described herein, as will be appreciated. Of course, where the motor is in the gun, the advantages of the remote motor are not obtained.

Provision of a remotely disposed motor and a flexible drive cable substantially increase the power output to weight ratio over known electric staplers. The remote motor, when combined with the features of the air spring according to the invention, serves to provide a result previously unknown—that of an electric portable fastener apparatus capable of driving construction-duty fasteners upon single impact at efficiencies greater than comparable output conventional pneumatic staplers (and without the associated hoses and compressors) and with a gun weight and size significantly below those of known electric staplers of other constructions.

These and other advantages and modifications will become readily apparent to one of ordinary skill in the art without departing from the scope of the invention and applicants intend to be bound only by the claims appended hereto.

We claim:

1. A fastener driving apparatus comprising a fastener gun having, a fastener driving element, an air spring means including a drive piston operatively connected to said driving element, means to move said piston to charge said air spring means, and to release said piston, when said air spring means is charged, to drive said driving element for driving a fastener, and, said piston moving means including a drive gear mounted for reciprocal motion toward and into engagement with said driving element for moving said driving element to charge said air spring means, and away from said driving element to disengage and to release said driving element for driving a fastener.

2. Apparatus as in claim 1 wherein said means to move said piston comprises a motor and flexible drive cable means operatively connecting said motor to said gun for driving said piston.

3. Apparatus as in claim 2 further including gear means operatively connecting said flexible drive cable means to said driving element for moving said piston to charge said air spring means.

4. A fastener driving apparatus comprising, a fastener gun, a movable fastener driving element in said gun, compressible air spring means for driving said element from a charged position to drive a fastener, said air spring means being compressed in response to movement of said element to a charged position, jacking means for moving said element to a charged position compressing said air spring means, motor means connected to said jacking means for operating said jacking means, and said jacking means including a drive gear mounted for reciprocal motion toward and into engagement with said driving element for moving said driving element to charge said air spring means, and away from said driving element to disengage and to release said driving element for driving a fastener.

5. Apparatus as in claim 4 wherein said motor means is disposed remotely from said gun and further including flexible cable means operatively connecting said motor means to said jacking means.

6. Apparatus as in claim 4 wherein said jacking means is disposed to engage said fastener driving element and is operable to jack said element against said air spring means.

7. Fastener driving apparatus comprising, a fastener gun, a fastener driving element in said gun, driving means in said gun for driving said fastener driving element, means for jacking said element against said element driving means to charge said driving means for driving said element, means for operating said jacking means including a source of driving energy disposed remotely from said fastener gun, a flexible power transmitting member operatively connecting said remote source of energy to said jacking means and, wherein said means for jacking said element comprises a toothed rack on said fastener driving element and a selectively driven gear reciprocably movable toward and engageable with said rack for jacking it against said fastener element driving means, and away from said rack to release said driving element for driving a fastener.

8. Apparatus as in claim 7 wherein said fastener element driving means comprises an air spring.

9. Apparatus as in claim 7 wherein said source of energy comprises a motor and said flexible power transmitting member comprises a drive cable.

10. Apparatus as in claim 7, wherein teeth on an upper area of said rack for initial engagement of said driven gear therewith have faces which are tapered greater than remaining teeth on a lower portion of said rack.

11. A fastener driving apparatus comprising a fastener gun, a fastener driving element in said gun, said driving element comprising a fastener engaging and driving portion and an driven portion laterally spaced from and extending along said engaging and driving portion, means in said gun for driving said fastener driving element to drive a fastener, means for jacking said element against said driving means for charging said driving means, said jacking means comprising a driven rack operatively disposed on said portion, and, a gear means for engaging said rack and jacking said element, said gear means being movable in opposite directions toward and away from said rack for respective engagement and disengagement therewith.

12. Apparatus as in claim 11 wherein said driven portion and said rack are integral with said fastener driving element.

13. Apparatus as in claim 12 wherein said driving element comprises a beam having a web joining two parallel flanges, said toothed rack being formed on one edge of each of said flanges.

14. Apparatus as in claim 11 wherein said driving means comprises an air spring.

15. Apparatus as in claim 11 further including motor means for driving said jacking means and a flexible drive cable operatively connecting said motor means to said jacking means.

16. Apparatus as in claim 11, wherein said gear means includes a drive gear movable reciprocally toward and away from said rack, and wherein teeth on an upper area of said rack for initial engagement by said drive gear therewith have faces which are tapered greater than the faces of the remaining teeth on a lower portion of said rack.

17. In a fastener driving apparatus having a fastener driving element and driving means for driving said element to drive a fastener, apparatus for charging said driving means comprising:

a toothed rack on said driving element, and a driven rack drive gear mounted for movement toward and away from said rack for respectively engaging said rack to drive it in one direction to charge said driving means and for moving away from said rack to release said rack and said driving element to move in an opposite direction to said one direction for driving a fastener.

18. Apparatus as in claim 17 wherein said rack has upper and lower areas, an initial engagement of said drive gear with said rack being in said upper area and said rack having in said upper area teeth with faces tapering greater than the taper of teeth in said lower area.

19. In a fastener driving apparatus including an element for driving fasteners and drive means for driving said element, means for jacking said element against said drive means to charge said drive means, said jacking means comprising, a toothed rack on said element, a drive gear mounted for selective engagement with and disengagement from said element, a second gear operatively engaging said drive gear and mounted on a gear shaft, a third gear mounted on said shaft, a segmented gear disposed for engagement with said third gear throughout a toothed segment thereof and disengaged from said third gear throughout a relieved section thereof, and said apparatus further including motor means for driving said segmented gear and operatively connected thereto.

20. Apparatus as in claim 19 wherein said motor means is electric and further including control means for controlling said motor, said control means comprising a switch, a cam connected for rotation with said segmented gear, and means connecting said cam to said switch for operative control of said motor means in relationship to the angular position of said segmented gear.

21. Apparatus as in claim 20 wherein said control means further includes a trigger, and relay means for starting, maintaining and stopping said motor means in response to the position of said trigger.

22. Apparatus as in claim 21 wherein said relay means and said switch are operative to continuously energize said motor means when said trigger is held in a run position to continuously drive fasteners.

23. Apparatus as in claim 19 wherein said drive gear is mounted on a drive shaft rotatably mounted in a journal member mounted on said gear shaft.

24. Apparatus as in claim 23, wherein said journal member is frictionally mounted on said gear shaft and wherein rotation of said gear shaft frictionally drives said journal member and moves said drive shaft carrying said drive gear into engagement with said rack.

25. Apparatus as in claim 24 wherein said rack has upper and lower areas, an initial engagement of said drive gear with said rack being in said upper area and said rack having in said upper area teeth with faces tapering greater than the taper of teeth in said lower area.

26. Apparatus as in claim 24 wherein said journal member and said drive gear rotate away from said rack when said toothed segment of said segmented gear disengages from said third gear.

27. Apparatus as in claim 19 including a flexible drive cable operatively connecting said motor means to said segmented gear.

28. Apparatus as in claim 19 wherein said drive means comprises an air spring.

29. Apparatus for driving staples, having a predetermined width, through a staple drive track and comprising:

a staple gun, and, a staple driving means in said gun for driving staples, said driving means comprising a staple driving element within said drive track for engaging and driving staples therethrough, and a driven element integral with said driving element and disposed outside of, and extending from and along said drive track.

30. Fastener driving apparatus of the type having a fastener driving element for engaging and driving fasteners through a fastener drive path and chargeable driving means for driving said fastener driving element, wherein the improvement comprises an integral fastener driving element having an elongated first portion disposed for engaging and driving fasteners within said path, and a second integral portion extending from and alongside said first portion and said path, and further including means for engaging said second integral portion and for moving it to charge said chargeable driving means.

31. Staple driving apparatus comprising:

a staple gun, a staple drive path within said gun, a staple engaging and driving element slidably disposed in said drive path for driving staples along said path, means for driving said driving element, and means for charging said driving means, said means for charging said driving means comprising a toothed rack disposed along an edge of said driving element within said drive path.

* * * * *